US010919134B2

(12) United States Patent
Miyazaki et al.

(10) Patent No.: US 10,919,134 B2
(45) Date of Patent: Feb. 16, 2021

(54) IMPACT ROTARY TOOL

(71) Applicant: Panasonic Intellectual Property Management Co., Ltd., Osaka (JP)

(72) Inventors: Hiroshi Miyazaki, Mie (JP); Hiroyuki Tsubakimoto, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 503 days.

(21) Appl. No.: 15/117,918

(22) PCT Filed: Feb. 23, 2015

(86) PCT No.: PCT/JP2015/000844
§ 371 (c)(1),
(2) Date: Aug. 10, 2016

(87) PCT Pub. No.: WO2015/133082
PCT Pub. Date: Sep. 11, 2015

(65) Prior Publication Data

US 2017/0008156 A1 Jan. 12, 2017

(30) Foreign Application Priority Data

Mar. 4, 2014 (JP) ..... 2014-041993

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01)

(58) Field of Classification Search
CPC ..... B25F 5/00; B25B 21/02; B25B 23/147; B25B 23/1475
(Continued)

(56) References Cited

U.S. PATENT DOCUMENTS 7,334,648 B2 * 2/2008 Arimura ..... B25B 21/02 173/176
2002/0153856 A1 * 10/2002 Gilmore ..... B23P 19/066 318/599
(Continued)

FOREIGN PATENT DOCUMENTS

EP 1595649 A2 11/2005
JP H08-290368 A 11/1996
(Continued)

OTHER PUBLICATIONS

International Search Report issued in Application No. PCT/JP2015/000844 dated Apr. 7, 2015, with English translation.
(Continued)

*Primary Examiner* — Stephen F. Gerrity
*Assistant Examiner* — Joshua G Kotis
(74) *Attorney, Agent, or Firm* — McDermott Will & Emery LLP

(57) ABSTRACT

An impact rotary tool comprises a driving source that is supplied with power from a battery pack and that rotates a hammer via a drive shaft, and a controlling unit that controls the driving source. The controlling unit controls the driving source so that the striking force is limited by PWM control when the battery pack voltage is high and the striking force is maintained even when the battery pack voltage decreases.

9 Claims, 4 Drawing Sheets

(58) Field of Classification Search
USPC ..... 173/2, 117, 217, 93.5, 93.6, 176
See application file for complete search history.

(56) References Cited

U.S. PATENT DOCUMENTS

2003/0090227 A1* 5/2003 Ito ..... B25B 23/1405 318/434
2003/0127932 A1* 7/2003 Ishida ..... B25F 5/00 310/184
2005/0040206 A1* 2/2005 Adams ..... B25C 1/008 227/131
2005/0073282 A1* 4/2005 Carrier ..... B25F 5/00 320/106
2005/0109519 A1 5/2005 Kawai et al.
2005/0217874 A1* 10/2005 Forster ..... B25C 1/06 173/1
2005/0263303 A1* 12/2005 Shimizu ..... B25B 23/1475 173/2
2006/0185869 A1* 8/2006 Arimura ..... B25B 23/1475 173/176
2009/0014192 A1* 1/2009 Ito ..... B23P 19/066 173/1
2009/0084568 A1 4/2009 Arimura et al.
2009/0108806 A1* 4/2009 Takano ..... B25F 5/02 320/112
2009/0295313 A1* 12/2009 Suzuki ..... B25F 5/00 318/139
2010/0027979 A1* 2/2010 Matsunaga ..... B25F 5/00 388/811
2010/0193205 A1* 8/2010 Cecchin ..... B25D 11/005 173/5
2011/0114347 A1* 5/2011 Kasuya ..... B25D 11/005 173/11
2011/0203822 A1* 8/2011 Harada ..... B25B 21/02 173/20
2011/0214894 A1* 9/2011 Harada ..... B25B 21/02 173/181
2011/0315417 A1* 12/2011 Matsunaga ..... B25B 21/008 173/176
2012/0191250 A1* 7/2012 Iwata ..... B25F 5/00 700/275
2012/0223663 A1* 9/2012 Dietl ..... H02P 25/188 318/139
2012/0279736 A1* 11/2012 Tanimoto ..... B25B 21/02 173/2
2012/0293096 A1* 11/2012 Mizoguchi ..... B25F 5/00 318/139
2013/0014967 A1* 1/2013 Ito ..... B25F 5/021 173/93
2013/0015789 A1 1/2013 Miyazaki et al.
2013/0068491 A1* 3/2013 Kusakawa ..... B25B 21/00 173/176
2013/0098646 A1* 4/2013 Funabashi ..... B25F 5/00 173/2
2013/0186666 A1* 7/2013 Yoshino ..... B25B 23/1475 173/176
2013/0193881 A1* 8/2013 Muto ..... H02P 3/02 318/139
2013/0264087 A1 10/2013 Harada et al.
2013/0333910 A1* 12/2013 Tanimoto ..... B25B 21/02 173/176
2014/0147718 A1* 5/2014 Furui ..... H01M 2/1055 429/99
2014/0225544 A1* 8/2014 Mergener ..... B25D 17/00 318/400.22
2015/0022125 A1* 1/2015 Takano ..... H02P 27/08 318/139
2015/0041164 A1* 2/2015 Sergyeyenko ..... B25B 21/00 173/1
2015/0042246 A1* 2/2015 Tadokoro ..... B25F 5/00 318/114
2015/0165604 A1* 6/2015 Bartoszek ..... B25B 21/02 173/1
2015/0303842 A1* 10/2015 Takano ..... B25F 5/00 173/2
2015/0336249 A1* 11/2015 Iwata ..... B25B 21/02 173/1
2016/0250738 A1* 9/2016 Leh ..... B25B 21/02 173/176

FOREIGN PATENT DOCUMENTS

JP 2000-176854 A 6/2000
JP 2005-118910 A 5/2005
JP 2006-026852 A 2/2006
JP 2009-083038 A 4/2009
JP 2009-190158 A 8/2009
JP 4370819 B2 11/2009
JP 2011-201006 A 10/2011
JP 2012-187695 A 10/2012
JP 2013-188850 A 9/2013

OTHER PUBLICATIONS

English Translation of International Preliminary Report on Patentability issued in International Application No. PCT/JP2015/000844, dated Sep. 6, 2016.
Extended European Search Report issued in Application No. 15759264.3 dated Feb. 27, 2017.

* cited by examiner

IMPACT ROTARY TOOL

RELATED APPLICATIONS

This application is the U.S. National Phase under 35 U.S.C. § 371 of International Application No. PCT/JP2015/000844, filed on Feb. 23, 2015, which in turn claims the benefit of Japanese Application No. 2014-041993, filed on Mar. 4, 2014, the disclosures of which are incorporated by reference herein.

TECHNICAL FIELD

The present invention relates an impact rotary tool.

BACKGROUND ART

A typical impact rotary tool includes a battery pack, a motor, a reduction drive, and a rotation hammer. Striking with the rotation hammer outputs pulsed torque (refer to, for example, Patent Document 1).

When an impact rotary tool is used to tighten a fastener such as a bolt or a screw, neither excessive tightening nor insufficient tightening of the fastener are preferred. Thus, a conventional impact tool includes a control circuit that counts the number of hammer strikes and stops generating strikes when the counted number reaches a reference strike number to avoid excessive tightening. The control circuit calculates the striking speed of the hammer that is proportional to the striking energy and corrects the reference strike number when the calculated striking speed is less than or equal to a reference striking speed to avoid insufficient tightening.

PRIOR ART DOCUMENT

Patent Document 1: Japanese Laid-Open Patent Publication No. 2005-118910

SUMMARY OF THE INVENTION

Problems that are to be Solved by the Invention

An impact rotary tool is used for a variety of rotation tasks. For example, when a rotation task is performed for a hard joint of a bolt and a fastened member, the load applied to a motor of the impact rotary tool rapidly increases immediately before the tightening is completed. When a rotation task is performed for a soft joint of the bolt and the fastened member, the load applied to the motor slowly increases from when the bolt is seated to when the tightening is completed. When the voltage of the battery pack decreases, the output (or torque) of the motor may greatly decrease or slightly decrease depending on the type of the rotation task. For example, the torque accuracy may become insufficient due to the voltage of the battery pack.

It is an object of the present invention to provide an impact rotary tool that maintains the torque accuracy.

An impact rotary tool according to one aspect of the present invention includes a drive source supplied with power from a battery pack to rotate a hammer with a drive shaft, an output shaft rotated when struck by the hammer, a strike detector that detects striking by the hammer, a rotation speed detector that detects a rotation speed of the drive shaft, a rotation angle detector that detects a rotation angle of the output shaft during a strike interval from when the strike detector detects a preceding strike to when the strike detector detects a following strike, a torque calculator that calculates striking energy from an input rotation average speed during the strike interval, which is calculated based on the rotation speed of the drive shaft detected by the rotation speed detector, and calculates a tightening torque based on the calculated striking energy and the rotation angle of the output shaft during a strike interval detected by the rotation angle detector, and a controller that controls the drive source based on the tightening torque calculated by the torque calculator. The controller performs PWM control to limit strike force applied when the voltage of the battery pack is high and controls the drive source to maintain strike force even when the voltage of the battery pack is low.

One aspect of the present invention provides an impact rotary tool that maintains the torque accuracy. Other aspects and advantages will become apparent from the following description and the accompanying drawings that illustrate the examples of the technical ideas according to the present invention.

EMBODIMENTS OF THE INVENTION

Figure 1:
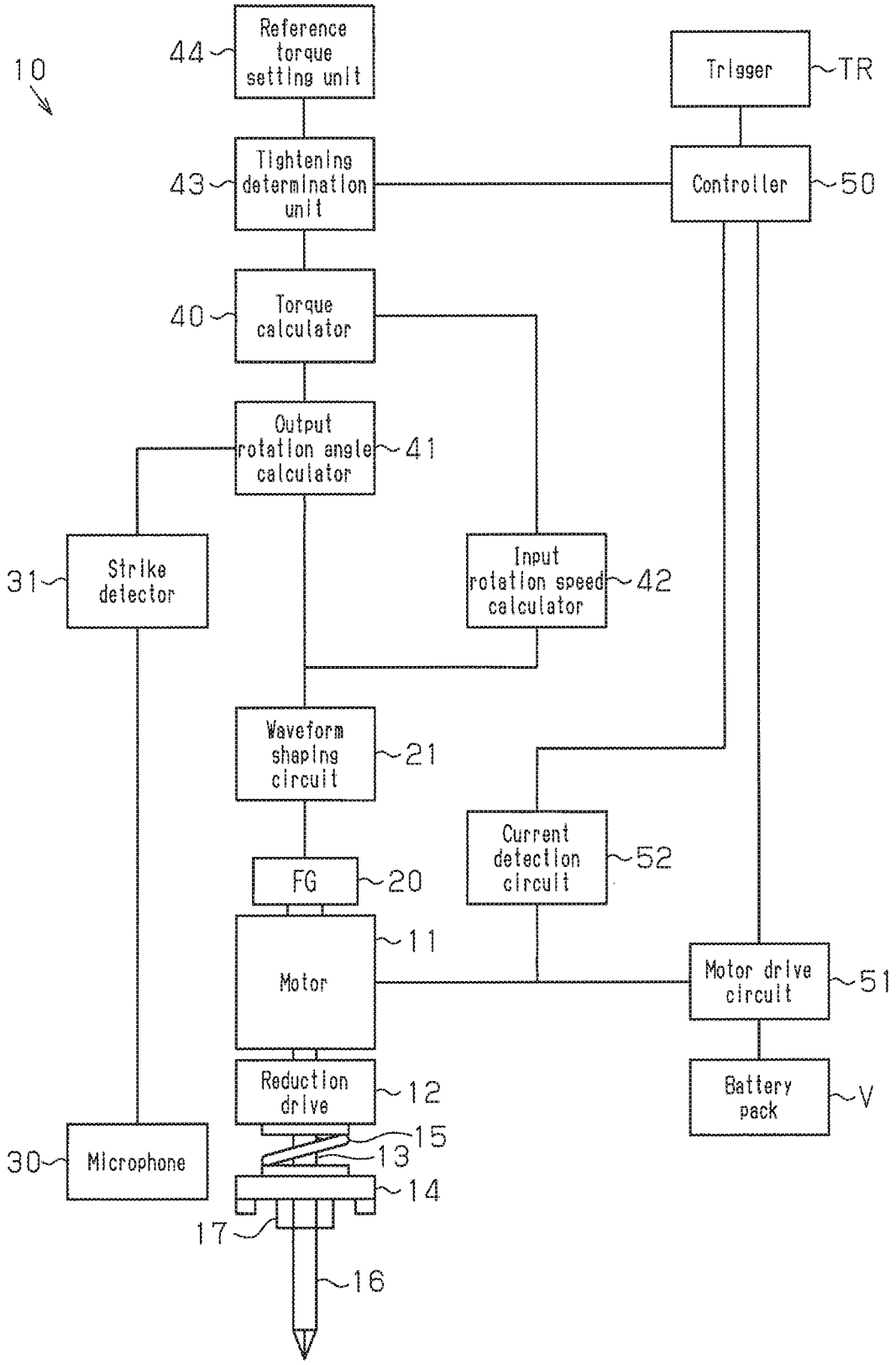
FIG. 1 is a block diagram showing one embodiment of an impact rotary tool.

One embodiment of an impact rotary tool 10 will now be described with reference to the drawings. The impact rotary tool 10 is a handheld tool that can be used as, for example, an impact driver or an impact wrench. As shown in FIG. 1, the impact rotary tool 10 includes a motor 11 that serves as a drive source. The motor 11 is a DC motor such as a brush motor or a brushless motor. The motor 11 is connected to a reduction drive 12. The rotation produced by the motor 11 is transmitted through the reduction drive 12 to a drive shaft 13. A hammer 14 is coupled to the drive shaft 13 by a cam mechanism (not shown). The hammer 14 is movable on the drive shaft 13 in an axial direction. A spring 15 biases the hammer 14 toward a distal end of an output shaft 16, that is, toward the front.

The output shaft 16 includes an anvil 17. The anvil 17 engages the hammer 14 when the hammer 14 rotates at a front position. When a load is not applied to the output shaft 16, the hammer 14 rotates integrally with the output shaft 16. When a load having a predetermined value or greater is applied to the output shaft 16, the hammer 14 moves backward on the drive shaft 13 against the biasing force of the spring 15. When the anvil 17 is disengaged from the hammer 14, the hammer 14 moves forward while rotating and strikes the anvil 17 to rotate the output shaft 16.

The drive shaft 13 functions as an input shaft of an impact mechanism including the hammer 14 and the anvil 17. The output shaft 16 functions as an output shaft of the impact mechanism including the hammer 14 and the anvil 17.

The impact rotary tool 10 may include a motor sensor 20 serving as a frequency generator (FG) that detects rotation of the motor 11. The motor sensor 20 generates a pulse signal having a pulse width or a pulse interval that is in accordance with the rotation speed of the motor 11. The impact rotary tool 10 includes a strike detector 31 that detects striking of the hammer 14. For example, the strike detector 31 detects a strike from a strike noise picked up by a microphone 30. The strike detector 31 may use an acceleration sensor instead of or in addition to the microphone 30 to detect strikes. As disclosed in Japanese Laid-Open Patent Publication No. 2000-354976, the strike detector 31 may detect strikes based on changes in the pulse width or the pulse interval of a pulse signal of the motor sensor 20. The strike detector 31 provides a detection signal to an output rotation angle calculator 41.

It is preferred that a pulse signal of the motor sensor 20 be provided through a waveform shaping circuit 21 to the output rotation angle calculator 41 and an input rotation speed calculator 42.

The input rotation speed calculator 42 calculates an input rotation speed of the impact mechanism based on the pulse signal of the motor sensor 20 and provides the calculation result to a torque calculator 40. The input rotation speed of the impact mechanism is, for example, the rotation speed of the drive shaft 13 but may be a rotation speed of the motor 11. The rotation speed calculated by the input rotation speed calculator 42 may be fed back to the controller 50 directly or indirectly.

The output rotation angle calculator 41 calculates an output rotation angle of the impact mechanism based on the detection signal of the strike detector 31 and the pulse signal of the motor sensor 20 and provides the calculation result to the torque calculator 40. For example, the output rotation angle calculator 41 calculates the rotation angle of the output shaft 16 during a period (strike interval) from when the strike detector 31 detected the preceding strike to when the strike detector 31 detected the latest strike.

The torque calculator 40 estimates the current tightening torque based on the calculation results of the calculators 41 and 42 and, provides the estimated value of the current tightening torque to a tightening determination unit 43.

A reference torque setting unit 44 is configured to set or select a reference torque in accordance with a manual operation of a user. The reference torque setting unit 44 may be a mechanical switch. Alternatively, the reference torque setting unit 44 may be a memory or a resistor that stores a set or selected reference torque. In a preferred example, the reference torque setting unit 44 changes the set torque in a stepped or stepless manner in accordance with the rotation position of a rotary dial. The rotary dial may include nine positions from "1" and "2" to "8" and "9" in order from a smaller reference torque and an "OFF" position in which the reference torque is infinite.

The tightening determination unit 43 compares an estimated value of the current tightening torque with the reference torque set by the reference torque setting unit 44. At the point of time the current tightening torque exceeds the reference torque, the tightening determination unit 43 supplies a motor stop request to the controller 50. The controller 50 controls a motor drive circuit 51 in accordance with the motor stop request and interrupts the supply of power from a battery pack V, which may be a rechargeable battery, to stop the motor 11.

The controller 50 is electrically connected to a trigger TR that can be pulled by the user. The controller 50 controls and drives the motor 11 through the motor drive circuit 51 based on the operation of the trigger TR by the user.

A current detection circuit 52 detects the value of the current supplied to the motor 11 and supplies the detected current value to the controller 50. The current detection circuit 52 is connected to, for example, a node between the motor 11 and the battery pack V.

The output rotation angle calculator 41 may directly detect the rotation angle of the output shaft 16. Alternatively, the output rotation angle calculator 41 may calculate the rotation angle of the output shaft 16 from the pulse signal of the motor sensor 20. For example, the output rotation angle calculator 41 may calculate the rotation angle ΔRM of the drive shaft 13 from the pulse signal of the motor sensor 20 and calculating the rotation angle Δr of the output shaft 16 during the strike interval from ΔRM with the following equation.

$$\Delta r=(\Delta RM/K)-RI$$

Here, K represents a reduction ratio from the motor 11 to the output shaft 16, and RI represents an idle rotation angle of the hammer 14. The idle rotation angle RI is $2\pi/3$ when the hammer 14 engages the anvil 17 three times per rotation.

The torque calculator 40 calculates a tightening torque T with the following equation. Here, J represents the moment of inertia of the output shaft 16 (anvil 17), ω represents a drive shaft average rotation speed of the strike interval, and C1 represents a coefficient that is used to convert the drive shaft average rotation speed ω into striking energy (or tightening torque).

$$T=(J\times C1\times\omega^2)/2\times\Delta r$$

Here, the drive shaft average rotation speed ω of the strike interval is calculated by dividing, for example, the number of pulses of the pulse signal of the motor sensor 20 during the strike interval by the strike interval time.

The torque calculator 40 of this example may be configured by a standard single-chip microcomputer including a timer that measures the time between strikes and a counter that counts the number of pulses of the pulse signal of the motor sensor 20.

If the angular velocity of the hammer 14 measured at the moment when the hammer 14 strikes the anvil 17 can be accurately measured, the striking energy can be calculated accurately. However, the hammer 14 moves along the drive shaft 13 in the axial direction and receives an impact reaction force. Thus, it is difficult for a rotary encoder to be arranged in the hammer 14, and it difficult to accurately measure the momentary angular velocity of the hammer 14. Accordingly, the torque calculator 40 of the embodiment calculates the striking energy (approximate value) based on the drive shaft average rotation speed.

In a structure in which the spring 15 is located between the hammer 14 and the motor 11, the calculated tightening torque may include an error. The error in the calculated tightening torque may be caused by a decrease in the rotation speed of the motor 11 resulting from a decrease in the voltage of the battery pack V and by a change in the rotation speed of the motor 11 resulting from speed control corresponding to the operation of the trigger TR.

Therefore, it is preferred that the tightening torque T be estimated using a correction function F (ω), in which the drive shaft average rotation speed ω is a variable, instead of the coefficient C1.

$$T=(J\times F(\omega)\times\omega^2)/2\times\Delta r$$

The correction function F (ω) can be calculated in advance from an experiment that uses the actual impact rotary tool. For example, the value of the correction function F (ω), that is, the correction coefficient increases as the drive shaft average rotation speed ω decreases. The calculated tightening torque is corrected in accordance with the drive shaft average rotation speed ω. This increases the tightening torque estimation accuracy and allows for accurate tightening with the desired tightening torque.

A referential example will now be described. In the referential example, the resolution of the motor sensor 20 serving as a rotation angle sensor is 24 pulses per rotation, the deceleration ratio K is 8, and the hammer 14 is engageable with the anvil 17 twice per rotation. When a single strike does not rotate the output shaft 16 at all, the number of pulses of the strike interval is 96 ((½)×8×24) When a single strike rotates the output shaft 16 by 90 degrees, the number of pulses of the strike interval is 144 ((½)+(¼)×8×24). That is, when 144 pulses are output from the motor sensor 20 during the strike interval, the output shaft 16 is rotated by 90 degrees from 48 (144−96) pulses. The rotation angle Δr of a screw and the corresponding number of output pulses are 1.875 degrees for 1 pulse, 3.75 degrees for and 2 pulses, 5.625 degrees for 3 pulses, 7.5 degrees for 4 pulses, 45 degrees for 24 pulses, and 90 degrees for 48 pulses, respectively.

In the reference example, the tightening torque may be extremely large. In such a case, when the rotation angle of the output shaft 16 is three degrees, the number of detected output pulses is one or two. The estimated torque obtained from the above equation when the number of detected output pulses is one is twice as large as when the number of detected output pulses is two. That is, when the torque is high, the estimated torque may include a large error, and the controller 50 may erroneously stop the motor 11. A sensor that detects the drive shaft rotation angle with an extremely high resolution can reduce errors but is not preferred since the sensor would cause the impact rotary tool 10 to be expensive.

Therefore, the controller 50 of the embodiment subtracts an offset number that is less than 96 (for example, 94), instead of the pulse number corresponding to a rotation of the hammer 14 (96 in the referential example) from the number of pulses of the pulse signal of the motor sensor 20 counted during the strike interval. When the offset number is 94, the number of detected pulses is three or four when the output shaft rotation angle is three degrees. The estimated torque when the number of detected pulses is three is approximately 1.3 times greater than when the number of detected pulses is four. The employment of the offset number reduces errors. In this case, the numerator of the torque estimation equation can be multiplied by two or three and corrected. When the output rotation angle is large (for example, 90 degrees), the error in the pulse number resulting from the employment of the offset number is 48 pulses when not offset and 50 pulses when offset. Thus, the error is small enough to be negligible.

Figure 2:
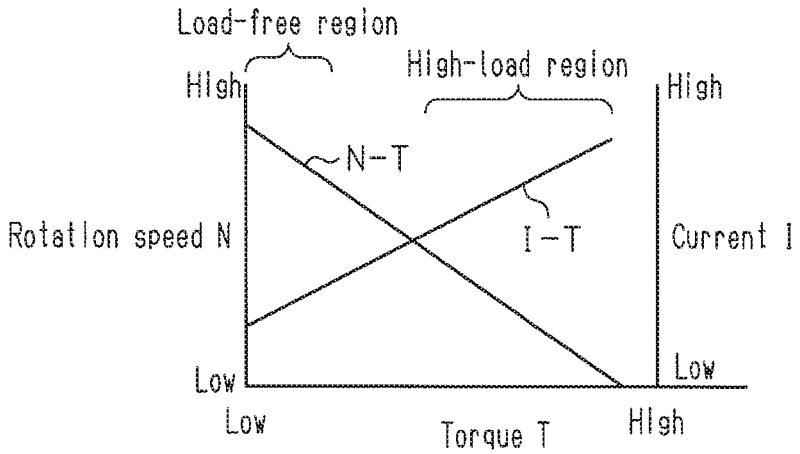
FIG. 2 is a graph showing the characteristics of the impact rotary tool of FIG. 1, in which the horizontal axis represents torque, the left axis represents rotation speed, and the right axis represents current.
Figure 3:
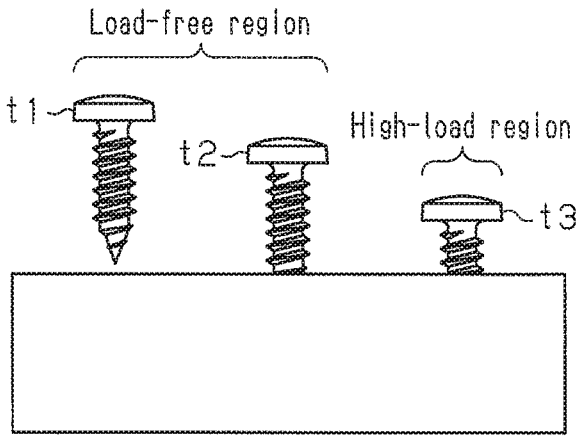
FIG. 3 is a schematic diagram showing the region illustrated in FIG. 2.

FIG. 2 shows an N-T characteristic line and an I-T characteristic line of the motor 11. A load-free region shown in FIG. 2 corresponds to substantially load-free and low-load tightening tasks such as those shown in FIG. 3 at t1, which is a state before tightening is performed, and t2, which is a state immediately after a tightening task is started. In the load-free region, the current is low. A high-load region shown in FIG. 2 corresponds to a tightening task in which the load rapidly increases and generates an impact such as that shown in FIG. 3 at t3, which is a state immediately before a tightening task. In the high-load region, the current may rapidly increase.

Thus, the controller 50 performs PWM control to control the rotation speed of the motor 11. The controller 50 may be configured to change the duty ratio of a control signal that controls the motor 11 in accordance with the rotation speed calculated by the input rotation speed calculator 42, the voltage of the battery pack V, and/or the current value that is fed back from the current detection circuit 52.

Figure 4:
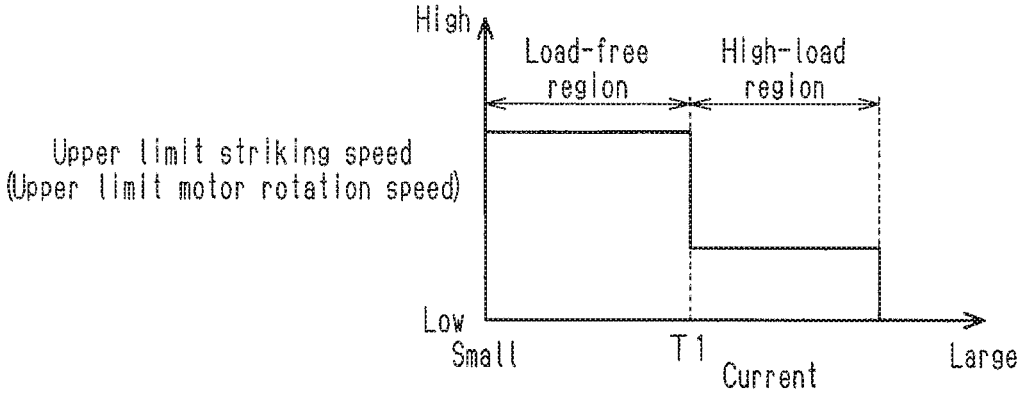
FIG. 4 is a graph showing the upper limit striking speed that differs in accordance with the current.

In the example of FIG. 4, when the current detected by the current detection circuit 52 is in the load-free region and lower than a current threshold TI, the controller 50 does not limit an upper limit striking speed (upper limit motor rotation speed). When the current is in the high-load region and higher than or equal to the current threshold TI, the controller 50 limits the upper limit rotation speed to a low value. The load-free region allows the motor 11 to rotate at a high speed and shortens the time of the tightening task. The high-load region limits the rotation speed of the motor 11 to maintain the torque accuracy in the high-load region. It is preferred that the current threshold TI be equal to the current value detected by the current detection circuit 52 when the load of the impact rotary tool 10 increases to the high-load region that generates an impact. The current threshold TI may be referred to as the impact determination threshold. The map (FIG. 4) of the current and the upper limit striking speed (limit value) is stored in, for example, the controller 50.

Figure 5:
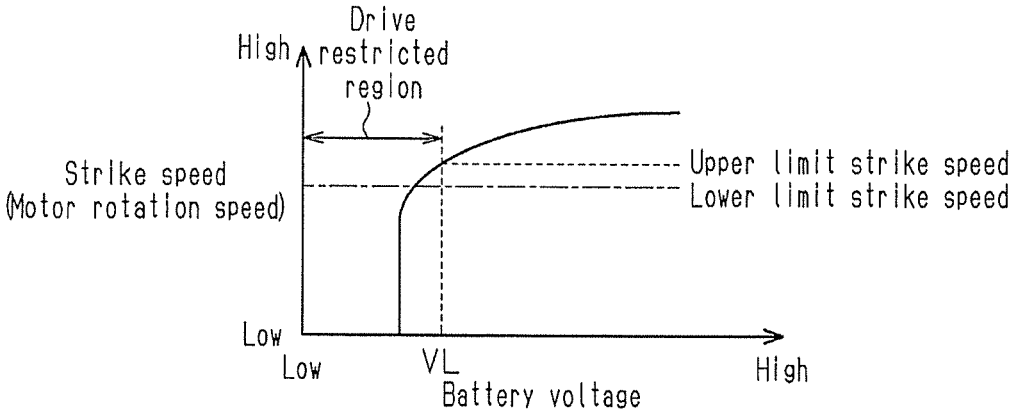
FIG. 5 is a graph showing the relationship of the voltage of a battery pack and the striking speed.

Referring to FIG. 5, it is preferred that the limit value of the upper limit motor rotation speed be set to be equal to the value of the rotation speed of the motor 11 when the voltage of the battery pack V is a lower limit voltage VL of an expected use voltage range of the impact rotary tool 10. The upper limit motor rotation speed is limited to the limit value to reduce the difference between strike forces applied when the voltage of the battery pack V is high and low in the expected use voltage range. When the voltage of the battery pack V is lower than the lower limit voltage VL, it is preferred that the controller 50 determine that the voltage decreases and restrict driving of the motor 11. The lower limit voltage VL of the expected use voltage range may be changed in accordance with the reference torque set by the reference torque setting unit 44.

Figure 6:
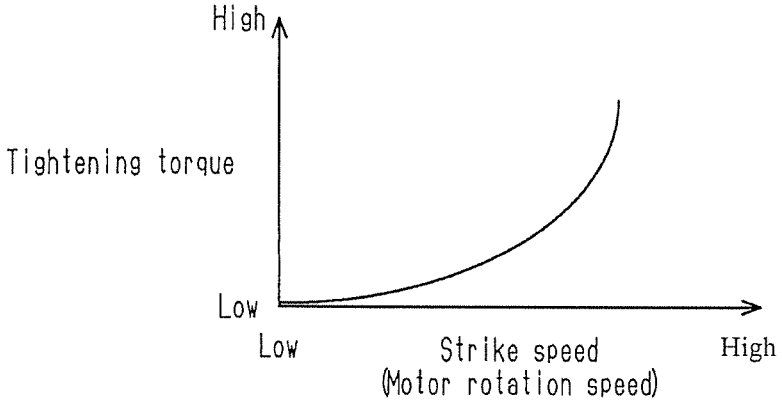
FIG. 6 is a graph showing the relationship of the striking speed and the tightening torque.
Figure 7:
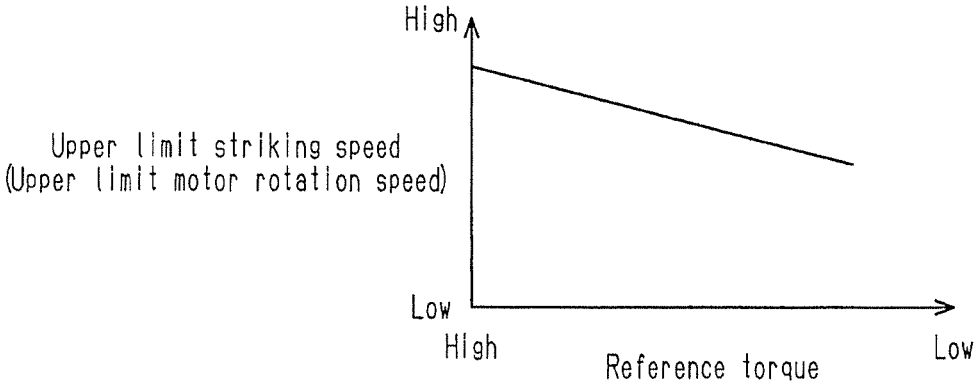
FIG. 7 is a graph showing the relationship of the reference torque set by a user and the upper limit striking speed.

FIG. 6 shows the relationship of the striking speed and the tightening torque. When a high tightening torque is not required, the impact speed may be low. Thus, it is preferred that, as shown in FIG. 7, the controller 50 decrease the upper limit striking speed as the reference torque set by the reference torque setting unit 44 decreases. For example, when the user sets a low reference torque, the impact rotary tool 10 can be used even when the voltage of the battery pack V is low. The map (FIG. 7) of the reference torque and the upper limit, striking speed (limit value) is stored in, for example, the controller 50.

The embodiment has the advantages described below.

(1) The controller 50 performs PWM control to limit the applied strike force when the voltage of the battery pack V is high and controls the motor 11 to maintain, the strike force even when the voltage of the battery pack V decreases. The strike force applied when the voltage of the battery pack V is high is limited to maintain the torque accuracy regardless of the voltage of the battery pack V as long as the voltage of the battery pack V is within the expected use range. This allows the impact rotary tool 10 to stably output the desired torque regardless of the type of rotation task.

(2) The controller 50 stops the motor 11 when the tightening torque calculated by the torque calculator 40 becomes greater than or equal to the reference torque set by the reference torque setting unit 44. This limits excessive tightening.

(3) The controller 50 reduces the upper limit rotation speed (target rotation speed) of the motor 11 based on the current detected by the current detection circuit 52 and the impact determination threshold TI when determining that the load of the impact rotary tool 10 has increased to the high-load region that generates an impact. The rotation speed of the motor 11 is limited only in the high-load region. This allows the impact rotary tool 10 to tighten a fastener such as a screw or a bolt in the load-free region within a short time. Since the torque accuracy is maintained when impact is applied, the impact rotary tool 10 limits excessive tightening and insufficient tightening.

(4) The controller 50 restricts the driving of the motor 11 when the voltage of the battery pack V decreases to a level at which a strike force cannot be output (for example, less than lower limit voltage VL of expected use voltage range). This, for example, avoids a situation in which a tightening task is continued when the impact rotary tool 10 cannot output strike force.

(5) The reference torque setting unit 44 is configured so that the reference torque can be set and/or the reference torque can be switched between a set state and a non-set state. This improves the convenience for the user.

(6) The controller 50 controls the motor 11 to output a constant strike force that is in accordance with the reference torque set by the reference torque setting unit 44. For example, when the user sets a relatively low reference torque with the reference torque setting unit 44, the lower limit voltage (lower limit voltage VL of expected use voltage range) that can generate a constant strike force in accordance with the reference torque decreases (refer to FIG. 5). Thus, the setting of the reference torque may extend the usable time of the impact rotary tool 10.

The embodiment may be modified as described below.

The controller 50 may immediately stop the motor 11 when the current tightening torque is greater than or equal to the reference torque. Further, the controller 50 may stop the motor 11 when the tightening torque calculated by the torque calculator 40 becomes greater than or equal to the reference torque and when the count value of the number of strikes detected by the strike detector 31 subsequently reaches a predetermined number of strikes.

Figure 8:
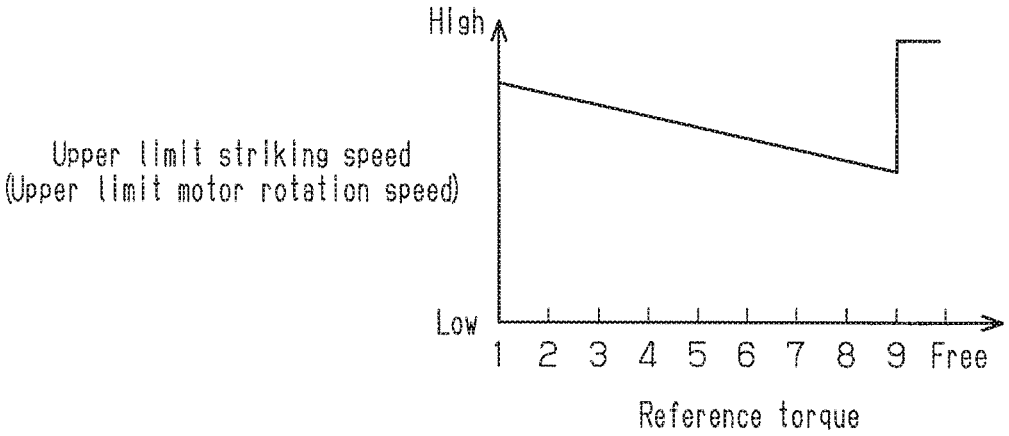
FIG. 8 is a graph showing the relationship of the reference torque and the upper limit striking speed in another example.

The controller 50 may remove the torque limit when the reference torque setting unit 44 is switched to the "OFF" state. For example, when the upper limit strike number corresponding to the "OFF" state is set to be excessively large or infinite as shown in FIG. 8, the virtual torque limit can be cancelled. When the user switches the reference torque setting unit 44 to the "OFF" state with a high voltage of the battery pack V, the torque limit of the impact rotary tool 10 is cancelled to obtain high torque.

The number of steps of the reference torque that can be set to the reference torque setting unit 44, may be changed.

The controller 50 can monitor or estimate the voltage of the battery pack V using a known method. For example, the controller 50 may include a known voltage monitoring circuit that monitors a voltage of the battery pack V, use the motor drive circuit 51 or a known voltage detection circuit to monitor a voltage of the battery pack V indirectly, or estimate a voltage of the battery pack V based on current, a rotation speed, and a voltage estimation algorithm.

The PWM control includes, for example, reduction of the duty ratio of a control signal that controls the motor 11 voltage of the battery pack V increases.

The motor drive circuit 51 may be included in the controller 50. The calculators 41 and 42, the torque calculator 40, and the tightening determination unit 43 may be included in the controller 50.

Some or all of the controller 50, the motor drive circuit 51, the calculators 41 and 42, the torque calculator 40, and the tightening determination unit 43 may be realized by one or more computer processors. For example, a single computer processor may be configured to realize the controller 50, the motor drive circuit 51, the calculators 41 and 42, the torque calculator 40, and the tightening determination unit 43 by executing a program code stored in a computer-readable storage medium such as RAM, ROM, or EEPROM.

The present invention encompasses the following implementations.

[1] In one implementation, an impact rotary tool (10) includes a drive source (11) supplied with power from a battery pack (V) to rotate a hammer (14) with a drive shaft (13), an output shaft (16) rotated when struck by the hammer (14), a strike detector (31) that detects striking by the hammer (14), a rotation speed detector (42) that detects a rotation speed of the drive shaft (13), a rotation angle detector (41) that detects a rotation angle of the output shaft (16) during a strike interval from when the strike detector (31) detects a preceding strike to when the strike detector (31) detects a following strike, a torque calculator (40) that calculates striking energy from an input rotation average speed during the strike interval, which is calculated based on the rotation speed of the drive shaft detected by the rotation speed detector (42), and calculates a tightening torque based on the calculated striking energy and the rotation angle of the output shaft during a strike interval detected by the rotation angle detector (41), and a controller (50) that controls the drive source based on the tightening torque calculated by the torque calculator (40). The controller (50) performs PWM control to limit strike force applied when the voltage of the battery pack (V) is high and controls the drive source (11) to maintain strike force even when the voltage of the battery pack (V) is low.

[2] In some implementations, the impact rotary tool (10) further includes a reference torque setting unit (44) used by a user to manually set or change a reference torque. The controller (50) stops the drive source when the tightening torque calculated by the torque calculator (40) becomes greater than or equal to the reference torque set by the reference torque setting unit (44).

[3] In some implementations, the impact rotary tool (10) further includes a reference torque setting unit (44) used by a user to manually set or chance a reference torque. The controller (50) stops the drive source when the tightening torque calculated by the torque calculator (40) becomes greater than or equal to the reference torque set by the reference torque setting unit (44) and a count value of a strike number detected by the strike detector (31) then reaches a predetermined strike number.

[4] In some implementations, the impact rotary tool (10) further includes a current detector (52) that detects current supplied to the drive source (11). The controller (50) decreases a target rotation, speed of the drive source (11)

when the current detected by the current detector (52) is greater than or equal to an impact determination threshold (T1).

[5] In some implementations, the controller (50) restricts driving of the drive source when the voltage of the battery pack (V) decreases to a level at which the strike force cannot be output.

[6] In some implementations, the impact rotary tool further includes a reference torque setting unit (44) used by a user to manually set or change a reference torque. The torque setting unit (44) is configured to switch between a set state and a non-set state of the reference torque.

[7] In some implementations, the impact rotary tool further includes a reference torque setting unit (44) used by a user to manually set or change a reference torque. The controller (50) controls the drive source to output constant strike force that is in accordance with the reference torque set by the reference torque setting unit (44).

[8] In a preferred example, an impact rotary tool (10) includes a motor (11) supplied with power from a battery pack to rotate a hammer (14) with a drive shaft (13), an output shaft (16) rotated when struck by the hammer, a motor drive circuit (51) connected to the motor and the battery pack, and a controller that directly or indirectly monitors the voltage of the battery pack and uses the motor drive circuit to control the motor. The controller performs PWM control on the motor in accordance with the voltage of the battery pack to limit a strike force applied when the voltage of the battery pack is a first voltage to be the same as a strike force applied when the voltage of the battery pack is a second voltage, which is lower than the first voltage.

[9] in some implementations, the controller (50) reduces a duty ratio of a control signal that controls the motor (11) as the voltage of the battery pack (V) increases.

[10] In some implementations, the first voltage is an upper limit voltage of an expected use voltage range of the battery pack (V) or a voltage that is around the upper limit voltage, and the second voltage is a lower limit voltage of the expected use voltage range or a voltage that is around the lower limit voltage.

The embodiment, the modifications, and the implementations may be combined with one another.

The present invention is to be considered as illustrative and not restrictive. The subject matter of the present invention may be included in fewer features than all of the disclosed features of the specific embodiments. The scope of the present invention and equivalence of the present invention are to be understood with reference to the appended claims.

The invention claimed is:

1. An impact rotary tool comprising:

a drive source supplied with power from a battery pack to rotate a hammer with a drive shaft;

an output shaft rotated when struck by the hammer;

a strike detector that detects striking by the hammer;

a rotation speed detector that detects a rotation speed of the drive shaft;

a rotation angle detector that detects a rotation angle of the output shaft during a strike interval from when the strike detector detects a preceding strike to when the strike detector detects a following strike;

a torque calculator that calculates striking energy from an input rotation average speed during the strike interval, which is calculated based on the rotation speed of the drive shaft detected by the rotation speed detector, and calculates a tightening torque based on the calculated striking energy and the rotation angle of the output shaft during the strike interval detected by the rotation angle detector; and a controller that controls the drive source based on the tightening torque calculated by the torque calculator, wherein the controller performs pulse width modulation (PWM) control to limit a strike force by the hammer so as to maintain the strike force over a usable voltage range of the battery pack, the impact rotary tool further comprises a current detector that detects current supplied to the drive source, the controller limits a upper limit rotation speed of the drive source to a limit value when the current detected by the current detector is greater than or equal to an impact determination threshold, the impact determination threshold is a threshold corresponding to a load that generates an impact, the limit value of the upper limit rotation speed is set to be equal to a value of the rotation speed of the drive source applied when the voltage of the battery pack is a lower limit voltage of the usable voltage range, the controller restricts driving of the drive source when the voltage of the battery pack is lower than the lower limit voltage, and when the current detected by the current detection circuit is in a load free region and lower than the impact determination threshold, the controller does not limit the upper limit rotation speed.

2. The impact rotary tool according to claim 1, further comprising a reference torque setting unit used by a user to manually set or change a reference torque, wherein the controller stops the drive source when the tightening torque calculated by the torque calculator becomes greater than or equal to the reference torque set by the reference torque setting unit.

3. The impact rotary tool according to claim 1, further comprising a reference torque setting unit used by a user to manually set or change a reference torque, wherein the controller stops the drive source when the tightening torque calculated by the torque calculator becomes greater than or equal to the reference torque set by the reference torque setting unit and a count value of a strike number detected by the strike detector reaches a predetermined strike number.

4. The impact rotary tool according to claim 1, wherein the lower limit voltage is a voltage level of the battery pack at which the strike force cannot be output.

5. The impact rotary tool according to claim 1, further comprising a reference torque setting unit used by a user to manually set or change a reference torque, wherein the torque setting unit is configured to switch between a set state and a non-set state of the reference torque.

6. The impact rotary tool according to claim 1, further comprising a reference torque setting unit used by a user to manually set or change a reference torque, wherein the controller controls the drive source to output a constant strike force that is in accordance with the reference torque set by the reference torque setting unit.

7. The impact rotary tool according to claim 1, wherein the drive source is a motor, and wherein the controller performs pulse width modulation (PWM) control on the motor in accordance with the voltage of the battery pack to limit a strike force applied when the voltage of the battery pack is a first voltage to be the same as a strike force applied when the voltage of the battery pack is a second voltage, which is lower than the first voltage.

8. The impact rotary tool according to claim 7, wherein the controller reduces a duty ratio of a control signal that controls the motor as voltage of the battery pack increases.

9. The impact rotary tool according to claim 7, wherein the first voltage is an upper limit voltage of the usable voltage range of the battery pack, and the second voltage is the lower limit voltage of the usable voltage range.

* * * * *